US006339224B1

(12) United States Patent
Takahara et al.

(10) Patent No.: US 6,339,224 B1
(45) Date of Patent: Jan. 15, 2002

(54) RADIATION INTENSIFYING SCREEN AND RADIATION RECEPTOR AND RADIATION INSPECTION APPARATUS USING THE INTENSIFYING SCREEN

(75) Inventors: Takeshi Takahara, Yokohama; Akihisa Saito, Kamakura; Eiji Oyaizu, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/423,282

(22) PCT Filed: May 6, 1998

(86) PCT No.: PCT/JP98/02007

§ 371 Date: Nov. 8, 1999

§ 102(e) Date: Nov. 8, 1999

(87) PCT Pub. No.: WO98/50923

PCT Pub. Date: Nov. 12, 1998

(30) Foreign Application Priority Data

May 6, 1997 (JP) ..... 9-115941
Aug. 27, 1997 (JP) ..... 9-231364

(51) Int. Cl.[7] ..... G21K 4/00

(52) U.S. Cl. ..... 250/486.1; 250/487.1; 250/483.1

(58) Field of Search ..... 250/486.1, 487.1, 250/483.1, 482.1, 484.2; 252/301.4 R, 301.4 S, 301.4 F, 301.36

(56) References Cited

U.S. PATENT DOCUMENTS 3,597,610 A * 8/1971 Bayol ..... 250/483.1
5,575,940 A * 11/1996 Lofftus ..... 252/62.63
5,814,932 A * 9/1998 Matsuda et al. ..... 313/461

FOREIGN PATENT DOCUMENTS

| | | | |
|---|---|---|---|
| JP | 53-22886 A | | 3/1978 |
| JP | B2-55-33560 | | 9/1980 |
| JP | A-58-71500 | | 4/1983 |
| JP | 58-156899 A | | 9/1983 |
| JP | 60-257400 A | | 12/1985 |
| JP | 61-258200 A | | 11/1986 |
| JP | 62-110199 A | | 5/1987 |
| JP | B2-1-57758 | | 12/1989 |
| JP | 8-313699 A | | 11/1996 |
| JP | A-8-313699 | | 11/1996 |
| JP | 411023798 | * | 1/1999 |
| JP | 411044798 A | * | 2/1999 |

* cited by examiner

*Primary Examiner*—Georgia Epps
*Assistant Examiner*—Richard Hanig
(74) *Attorney, Agent, or Firm*—Oblon, Spivak, McClelland, Maier & Neustadt, P.C.

(57) ABSTRACT

An intensifying screen, comprising a support, a phosphor layer disposed on the support and a protecting film disposed on the phosphor layer. The phosphor layer comprises a first phosphor layer formed on the support side and constituted of particles of the first phosphor having average particle diameter $D_1$ and range coefficient k, which expresses a particle size distribution, in the range of 1.3 to 1.8, and a second phosphor layer formed on the protective film side and constituted of particles of the second phosphor having average particle diameter $D_2$ ($>D_1$) and range coefficient k, which expresses a particle size distribution, in the range of 1.5 to 2.0. The ratio ($CW_1$:$CW_2$) of coating weight per unit area of the particles of the first phosphor in the first phosphor layer $CW_1$ and coating weight per unit area of the particles of the second phosphor in the second phosphor layer $CW_2$ is in the range of from 8:2 to 6:4. According to such intensifying screens, even when phosphors of, for instance, high emission efficiency are employed, while preventing lowering of speed and sharpness from occurring, granularity can be improved.

21 Claims, 5 Drawing Sheets

RADIATION INTENSIFYING SCREEN AND RADIATION RECEPTOR AND RADIATION INSPECTION APPARATUS USING THE INTENSIFYING SCREEN

TECHNICAL FIELD

The present invention relates to intensifying screens employed in X-ray radiography or the like, radiation receptors therewith, and radiation inspection devices therewith.

BACKGROUND ART

In X-ray radiography employed in medical diagnosis and non-destructive inspection for industrial purpose, in general intensifying screens are used in combination with X-ray film to enhance system sensitivity. An intensifying screen is generally formed by sequentially forming a phosphor layer and a relatively thin protective film on a support consisting of paper or plastic.

In recent years, reduction of subject's exposure to radiation in medical diagnosis or the like is strongly demanded. In order to cope with this demand, in X-ray radiography, high-speed X-ray films or high-speed X-ray intensifying screens are used to reduce subject's exposure. In order to enhance sensitivity of X-ray film, high speed X-ray films are generally used. In order to enhance sensitivity of intensifying screens, phosphors of high emission efficiency are employed.

When X-ray films or intensifying screens are made highly sensitive, there occur the following problems. That is, when the high-speed X-ray films are employed, though lowering of sharpness is small, granularity is deteriorated. By contrast, when the high-speed intensifying screens are employed, there also occurs deterioration of granularity. Recognizability of a subject in X-ray radiography involves both of granularity and sharpness. Deterioration of granularity deteriorates in particular the recognizability of subjects of low contrast.

From the above, with an object to improve image quality of intensifying screens, various improvements of phosphor layers have been attempted. For instance, when a phosphor layer is produced by the use of a kind of settling method named "Ryuen Hou" in Japanese, a phosphor layer of which particle size distribution becomes smaller from the protective film side toward the support side, a structure in which particle size is graded can be obtained (Japanese Patent Publications (KOKOKU) No. Sho 55-33560 and No. Hei 1-57758). This kind of structure of phosphor layer can enhance speed and sharpness of intensifying screens.

However, the aforementioned intensifying screens of structure of graded particle size distribution are produced by drying solvent while letting settle phosphor particles in phosphor slurry by the use of gravity. Accordingly, it takes long time for produce to result in pushing up the production cost. In Japanese Patent Publications (KOKOKU) No. Sho 55-33560 and No. Hei 1-57758, a structure of multi-layers of phosphors of different particle sizes is disclosed. These patent publications disclose only examples of the structure of graded particle size distribution but does not disclose detailed conditions of each phosphor layer or the like.

By contrast, Japanese Patent Laid-open Publication (KOKAI) No. Sho 58-71500 discloses an intensifying screen in which the surface side of a phosphor layer thereof is constituted of larger phosphor particles of an average particle diameter of 7 to 20 $\mu$m, and interstices of the larger phosphor particles and support side thereof are constituted of phosphor particles of an average particle diameter of 4 $\mu$m or less. According to such an intensifying screen, sensitivity and sharpness can be improved by some degree. However, granularity can not be sufficiently improved.

In Japanese Patent Laid-open Publication No. (KOKAI) Hei 8-313699, there is disclosed an intensifying screen having a plurality of phosphor layers the support side of which layers is composed of phosphor particles of smaller average particle diameter. Each phosphor layer of this intensifying screen, when each average particle diameter of phosphor particles constituting each phosphor layer is R and particle size distribution thereof is $\sigma$, satisfies a relation of $0<\sigma/R\leqq 0.5$, respectively. Furthermore, in this patent publication, among the plurality of phosphor layers, the phosphor layer of the protective layer side has an average particle diameter of 10 to 20 $\mu$m and the phosphor layer of the support side has an average particle diameter of 1 to 5 $\mu$m.

Thus, in an intensifying screen having a plurality of phosphor layers, when particle size diameters of phosphor particles constituting the respective phosphor layers are stipulated similarly, sufficient improvement of sharpness and granularity is not necessarily obtained. By the experiments carried out by the inventors, it has been found that when a plurality of phosphor layers is composed of a plurality of phosphor particles of different average particle diameters, according to average particle diameters of the respective phosphor layers, various kinds of conditions have to be set.

As mentioned above, high speed intensifying screens due to the use of phosphors of high emission efficiency can be effective in reduction of subject's exposure and in improvement of sharpness, however, cause a problem of deterioration of granularity. On the contrary, when phosphors of low emission efficiency are used, the granularity can be improved but the sharpness deteriorates. Thus, there is a certain degree of reciprocity between radiographic performance.

As to such problems, existing intensifying screens having a structure composed of single phosphor layer can not satisfy both of granularity and sharpness. The intensifying screens having a structure of graded particle diameter distribution are relatively satisfactory with respect to speed and sharpness. However, it takes longer time for formation of phosphor layer to result in pushing-up of manufacturing cost and at the same time due to fluctuation of manufacturing conditions, large performance variation is invited. Further, in the existing intensifying screens having a plurality of phosphor layers of different average particle diameters, the sharpness and granularity have not been sufficiently improved.

In contrast, radiation is used not only for radiography of medical diagnosis but also for treatment of subjects. A device for radiotherapy is one in which a high energy X-ray beam of approximately 4 MV obtained from a linear accelerator called linac is irradiated to an subject to cure. Before beginning treatment with a device for radiotherapy, in order to confirm reproducibility of a portion being exposed that is set by treatment program, radiography or TV imaging is carried out with the beam being used for treatment.

However, there is a problem that in the aforementioned high energy X-rays, when an X-ray image is taken with an ordinary intensifying screen after transmission of X-rays of a subject, sufficient contrast can not be obtained. To this end, so far, a fluorometallic screen that is composed of integration or superposition of an ordinary intensifying screen and a metallic plate such as lead alloy foil or copper plate, and medical X-ray film or industrial X-ray film are combined to employ. Silver halide in film emulsion has the maximum of spectral sensitivity at 45 kV. Accordingly, a high energy X-ray beam of 1 MV or more is absorbed less to result in poor efficiency. This is the reason why the fluorometallic screen has been employed.

A fluorometallic screen is composed of a phosphor layer of such as $CaWO_4$ in contact with a lead alloy foil, for instance. In such a fluorometallic screen, after appropriate absorption of a high energy X-ray beam at the lead alloy foil, a sensitizing effect due to emission of phosphor, an elimination effect of scattered X-rays due to the metallic foil, a sensitizing effect of phosphor due to secondary electrons due to Compton scattering or the like can be obtained.

However, there is a problem from an environment point of view as to handling of foils of lead alloy. Other than this, plate of heavy metal such as tungsten has been taken up. However, tungsten plate is much expensive that there is a problem when being put in practice. In contrast, a fluorometallic screen employing copper plate is small in X-ray absorption, that is, insufficient in absorption of high energy X-rays of 1 MV or more. In addition, existing fluorometallic screens are insufficient in speed, sharpness or the like, and recognizability of portions being treated is poor.

An object of the present invention is to provide multipurpose intensifying screens improved in speed, sharpness, granularity or the like.

A first more concrete object of the present invention is to provide an intensifying screen employing phosphor of high emission efficiency in which, while preventing deterioration of speed and sharpness from occurring, granularity is improved and mass-productivity is satisfied. In addition, another object of the present invention is, by employing such intensifying screens, to provide a radiation receptor and a radiation inspection device that realize reduction of for instance subject exposure and improve capability of diagnosis.

A second more concrete object of the present invention is to provide an intensifying screen that has sufficient absorption of high energy X-rays of 1 MV or more, for instance, and is improved in handling performance during manufacture and usage, and in speed and sharpness.

DISCLOSURE OF THE INVENTION

In order to look into likelihood of improving performance of an intensifying screen that has a plurality of phosphor layers of different average particle diameters, the present inventors have carried out detailed experiments concerning particle diameter and particle size distribution of phosphor particles constituting the respective phosphor layers, and packing density of the respective phosphor layers or the like. As the result of these experiments, it is found that the particle size distribution and packing amount of each phosphor layer are required to be controlled within an appropriate range according to the average particle diameter of phosphor particles constituting each layer.

A first intensifying screen of the present invention comprises a support, a first phosphor layer disposed on the support and constituted of particles of a first phosphor of which average particle diameter is $D_1$ and range coefficient k, which expresses particle size distribution, is in the range of 1.3 to 1.8, a second phosphor layer disposed on the first phosphor layer and constituted of particles of a second phosphor of which average particle diameter is $D_2$ that satisfies $D_2>D_1$ and range coefficient k, which expresses particle size distribution, is in the range of 1.5 to 2.0, and a protective layer disposed on the second phosphor layer.

A second intensifying screen of the present invention comprises a support, a first phosphor layer disposed on the support and constituted of particles of a first phosphor having an average particle diameter of $D_1$, a second phosphor layer disposed on the first phosphor layer and constituted of particles of a second phosphor having an average particle diameter of $D_2$ that satisfies $D_2>D_1$, and a protective layer disposed on the second phosphor layer, wherein when a coating weight per unit area of the particles of the first phosphor in the first phosphor layer is $CW_1$ and a coating weight per unit area of the particles of the second phosphor in the second phosphor layer is $CW_2$, the ratio of the $CW_1$ and $CW_2$ ($CW_1$:$CW_2$) is in the range of 8:2 to 6:4.

A radiation receptor of the present invention comprises an X-ray film, a front intensifying screen laminated along a surface of the subject side of the X-ray film and consisting of an intensifying screen of the present invention, a back intensifying screen laminated along a surface opposite to that of the subject side of the X-ray film and consisting of an intensifying screen of the present invention, and a cassette accommodating a laminate of the front intensifying screen, the X-ray film and the back intensifying screen.

A radiation inspection device of the present invention comprises a radiation source, and the aforementioned radiation receptor of the present invention that is disposed opposite to the radiation source through a subject.

Here, it is known that particle size distribution of powder such as phosphor particles can be approximated by lognormal distribution in most cases. That is, when particle diameter is d, x=log d, an average at this time is $\mu$, and standard deviation is $\sigma$, probability density function f(x) can be given by the following formula.

$$f(x)=(1/\sigma\sqrt{2\pi})\cdot(\exp[-(x-\mu)^2/2\sigma^2])$$

A probability of x being $x_0$ and less is called a cumulative distribution function F ($x_0$) and is expressed by the following formula.

$$F(x0)=\int_{-\infty}^{x0} f(x)\,dx$$

Phosphor particles being measured are put in a dispersion medium such as water and are dispersed well to measure particle size distribution by the use of Coulter counter method, micro-track method or the like. An average particle diameter of a phosphor is obtained as a median value of this particle size distribution.

FIG. 9 shows an example of a cumulative particle size distribution (in terms of weight) of a phosphor employed in intensifying screens of the present invention. In the figure, points show actual measurement data and a curved line shows a theoretical cumulative distribution of lognormal distribution decided so that average value $\mu$ and standard deviation $\sigma$ thereof meet the measured values. From this example, particle size distribution of phosphor is evident to be expressed well by the lognormal distribution. The particle size corresponding to 50% of vertical axis of this cumulative distribution curve is a median value of this particle size distribution and denoted as average particle diameter D. Width of particle size distribution can be characterized by range coefficient k.

The range coefficient k is defined as follows. When summation of weight of particles in the range of D/k–kD (total weight) is 68.2689% of the weight of whole particles, k is defined as a range coefficient. That is, k is a number of more than 1, the larger the value of k is, the broader is the particle size distribution, and the closer to 1 the k is, the sharper is the particle size distribution.

The first and second intensifying screens of the present invention have a phosphor layer of two-layer structure. A first phosphor layer thereof is formed on support side and consisting of particles of phosphor of smaller particle diameter, and a second phosphor layer thereof is formed on protective film side and consisting of particles of phosphor of larger particle diameter. In an intensifying screen of phosphor layer of two-layer structure, by narrowing the particle size distribution of phosphor particles of smaller particle diameter and by making relatively broader the particle size distribution of phosphor particles of larger particle diameter, sharpness and granularity can be improved. Further, by setting smaller the coating weight per unit area of particles of phosphor of the first phosphor layer constituted of particles of phosphor of particle diameter smaller than that of the second phosphor layer constituted of particles of phosphor of larger particle diameter, sharpness and granularity can be improved.

In the intensifying screen of the present invention, the phosphor layer of two-layer structure can be produced by applying an ordinary producing process as identical as the case of the ordinary phosphor layer. Accordingly, in addition to manufacture of intensifying screens themselves being easy, aimed performance can be obtained with reproducibility. Radiation receptors and radiation inspection devices of the present invention, due to adoption of the aforementioned intensifying screens, in particular even when radiography system is made highly sensitive, can obtain excellent recognizability.

The third intensifying screen of the present invention intends to enhance the contrast of radiographs taken with X-rays of high energy such as for instance 1 MV or more, and to improve speed, sharpness and granularity thereof.

That is, a third intensifying screen of the present invention comprises a support, a phosphor layer disposed on the support, a protective film disposed on the phosphor layer, and a powder layer. Here, the powder layer is disposed between the support and the phosphor layer and is consisting of at least one kind of particles selected from particles of simple metal, particles of alloy consisting mainly of metal and particles of compound consisting mainly of metal. Here, a thickness of the powder layer is in the range of 2 to 40 $kg/m^2$ in terms of weight per unit area. As metals to be used for the third intensifying screen, at least one kind of heavy metals such as W, Mo, Nb and Ta can be cited.

In the third intensifying screen of the present invention, a powder layer composed of particles of heavy metals such as W, Mo, Nb and Ta that are large in absorption of X-rays of high energy or composed of particles consisting mainly of heavy metal is disposed between a support and a phosphor layer. Such powder layer absorbs the X-rays of high energy up to an appropriate state corresponding to exposure speed of X-ray film. Accordingly, excellent contrast that can be applied to medical diagnosis can be obtained. Further, scattered X-rays can be effectively absorbed due to the powder layer and a sensitizing effect of phosphor due to secondary electrons based on Compton scattering can be obtained. As a result of these, speed, sharpness and granularity can be improved.

MODES FOR CARRYING OUT THE INVENTION

In the following, modes for carrying out the present invention will be explained.

Figure 1:
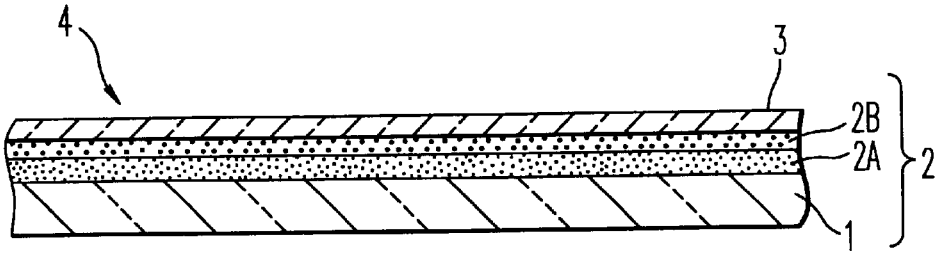
FIG. 1 is a cross section showing an essential structure of one embodiment of an intensifying screen of the present invention.

FIG. 1 is a cross section of an essential structure of one embodiment of first and second intensifying screens of the present invention. In the figure, reference numeral 1 denotes a support consisting of plastic film or nonwoven fabric, on one surface of the support 1 a phosphor layer 2 being disposed. On the phosphor layer 2, there is disposed a protective film 3 consisting of plastic film or covering film. Of these respective elements, an intensifying screen 4 to be used for radiography is constituted.

A phosphor layer 2 comprises a first phosphor layer 2*a* formed on the support 1 side and a second phosphor layer 2*b* formed on the protective film 3 side. Here, when an average particle diameter of a first phosphor particles constituting a first phosphor layer 2*a* is $D_1$ and an average particle diameter of a second phosphor particles constituting a second phosphor layer 2*b* is $D_2$, $D_1<D_2$ is satisfied. That is, on the support 1 side, a first phosphor layer 2*a* containing phosphor particles of smaller particle diameter is disposed, and on the protective film 3 side, a second phosphor layer 2*b* containing phosphor particles of larger particle diameter is disposed.

A phosphor layer 2 of two-layer structure consisting of phosphor particles of different average particle diameters may be formed of $CaWO_4$ phosphor or the like, it is, however, preferable to constitute particularly of rare earth phosphors such as $Gd_2O_2S$:Tb, LaOBr:Tb, BaFCl:Eu or the like of high emission efficiency. The first and second phosphor layers 2*a* and 2*b* are phosphor layers containing such particles of phosphors as described above, respectively.

The intensifying screens 4 involving rare earth phosphors of high emission efficiency are particularly preferable. Even when the rare earth phosphors of high emission efficiency are employed, since the phosphor layer 2 is constituted of two phosphor layers 2*a* and 2*b* of different average particle diameters, while preventing deterioration of speed and sharpness from occurring, granularity can be improved. In addition, the phosphor layers 2 of two-layer structure can be produced similarly with the ordinary phosphor layers, resulting in satisfying mass-productivity.

Figure 2:
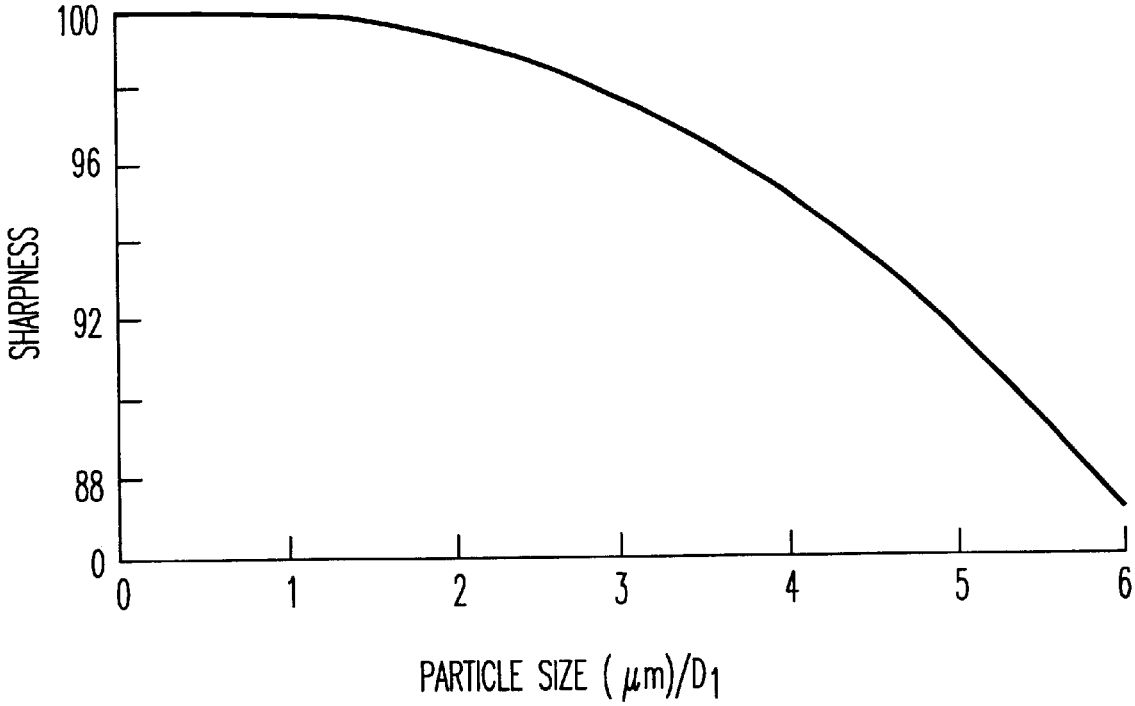
FIG. 2 is a diagram showing one example of sharpness performance when average particle diameter $D_1$ of phosphor particles constituting the first phosphor layer is varied in the intensifying screen shown in FIG. 1.

A first phosphor layer 2*a* disposed on a support 1 side is preferable to be constituted of phosphor particles of smaller particle diameter of an average particle diameter $D_1$ in the range of 1 to 5 $\mu$m. In FIG. 2, one example of sharpness performance when average particle diameter $D_1$ of the first phosphor particles constituting the first phosphor layer 2*a* is varied is shown. By the way, in FIG. 2, $Gd_2O_2S$:Tb phosphor particles are employed, average particle diameter $D_2$ of phosphor particles constituting the second phosphor layer 2*b* being 9 $\mu$m, and range coefficient k thereof being 1.6. The ratio ($CW_1$:$CW_2$) of coating weight per unit area $CW_1$ of phosphor particles of smaller particle diameter in the first phosphor layer 2*a* and coating weight per unit area $CW_2$ of phosphor particles of larger particle diameter in the second phosphor layer 2*b* is set at 7:3. In FIG. 2, such intensifying screens 4 are employed as back intensifying screen. Phosphor particles of smaller particle diameter that are employed here has range coefficient k of 1.5 to 1.8.

As obvious from FIG. 2, the smaller the average particle diameter $D_1$ of phosphor particles of smaller particle diameter is, the sharper the sharpness becomes. However, when average particle diameter $D_1$ is less than 1 $\mu$m, manufacture of phosphor particles itself becomes difficult, and the brightness and formability of the phosphor layer may be deteriorated. The average particle diameter $D_1$ of phosphor particles of smaller particle diameter constituting the first phosphor layer 2*a* is preferable to be 1 $\mu$m or more, accordingly. Further, upon suppressing lowering of the sharpness, the average particle diameter $D_1$ is preferable to be set at 5 $\mu$m or less, particularly preferable being 3 $\mu$m or less. By the way, when the intensifying screen 4 is employed as front screen, similar tendency arises.

The second phosphor layer 2*b* disposed on the protective film 3 side, in addition to satisfying $D_2>D_1$, is preferable to be constituted of larger phosphor particles of average particle diameter $D_2$ in the range of 5 to 20 $\mu$m. When the average particle diameter $D_2$ of phosphor particles is less than 5 $\mu$m, even if $D_2>D_1$ is satisfied, an effect of the second phosphor layer 2*b* employing phosphor particles of larger particle size can not be fully obtained.

Figure 3:
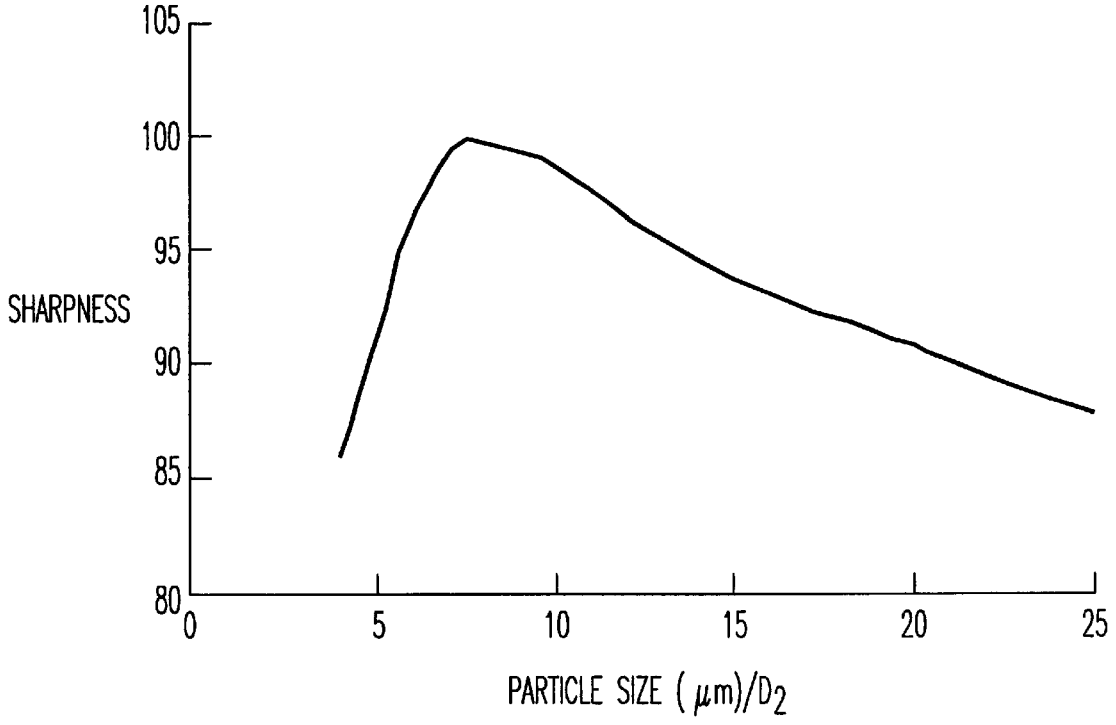
FIG. 3 is a diagram showing one example of sharpness performance when average particle diameter $D_2$ of phosphor particles constituting the second phosphor layer is varied in the intensifying screen shown in FIG. 1.

FIG. 3 shows one example of sharpness performance when average particle diameter $D_2$ of phosphor particles constituting the second phosphor layer 2*b* is varied. In FIG. 3, $Gd_2O_2S$:Tb phosphor particles are employed. Average particle diameter $D_1$ of phosphor particles constituting the first phosphor layer 2*a* is 2 $\mu$m, range coefficient k is 1.5, and the ratio of phosphor coating weights of the first phosphor layer 2*a* and the second phosphor layer 2*b* ($CW_1$:$CW_2$) is set at 7:3. In FIG. 3, such intensifying screens 4 are employed as the back screen. Employed phosphor particles of larger particle diameter has range coefficient k in the range of 1.6 to 1.8.

As obvious from FIG. 3, when the average particle diameter $D_2$ of larger phosphor particles is too large, the sharpness deteriorates largely. Accordingly, the average particle diameter $D_2$ is preferable to be 20 $\mu$m or less, further being preferable to be 10 $\mu$m or less. Since the sharpness also deteriorates when the larger phosphor particles has too small average particle diameter $D_2$, the average particle diameter $D_2$ is preferable to be 7 $\mu$m or more. When the intensifying screen 4 is employed as the front screen either, similar tendency exists.

Particles of each phosphor constituting the first and second phosphor layers 2*a* and 2*b* such as described above have such particle size distribution as shown in the following, respectively. That is, the phosphor particles of smaller particle size being employed in the first phosphor layer 2*a* have range coefficient k ($k_1$), which shows particle size distribution thereof, in the range of 1.3 to 1.8. By contrast, the phosphor particles of larger particle size being employed in the second phosphor layer 2*b* have range coefficient k ($k_2$), which shows particle size distribution thereof, in the range of 1.5 to 2.0. In particular, the range coefficient $k_1$ of the phosphor particles of smaller particle size and the range coefficient $k_2$ of the phosphor particles of larger particle size are preferable to satisfy $k_1<k_2$.

Thus, by making narrow the particle size distribution of the phosphor particles of smaller particle size one side and by making relatively broad the particle size distribution of the phosphor particles of larger particle size the other side, sharpness and granularity of the phosphor layer 2 of two-layer structure can be improved with reproducibility. When phosphor particles (both of smaller size phosphor particles and larger size phosphor particles) of which range coefficient k deviates from the aforementioned range are employed, improvement effect of sharpness and granularity due to two-layer structure of the phosphor layer 2 decreases.

That is, when the range coefficient $k_1$ of smaller size phosphor particles constituting the first phosphor layer 2*a* is less than 1.3, sharpness and speed are deteriorated largely, and when exceeding 1.8, the sharpness deteriorates. On the other hand, when the range coefficient $k_2$ of larger size phosphor particles constituting the second phosphor layer 2*b* is less than 1.5, the sharpness becomes remarkably low, and when exceeding 2.0, the sensitivity deteriorates largely. In addition, when $k_2$ is equal with $k_1$ or smaller than that, the sharpness decreases largely.

The range coefficient $k_1$ of smaller size phosphor particles constituting the first phosphor layer 2*a* is further preferable to be in the range of 1.5 to 1.7. The range coefficient $k_2$ of larger size phosphor particles constituting the second phosphor layer 2*b* is further preferable to be in the range of 1.6 to 1.8. By employing the smaller size phosphor particles and larger size phosphor particles having such range coefficients $k_1$ and $k_2$, the sharpness and granularity of the phosphor layer 2 of two-layer structure can be further improved.

Furthermore, the first phosphor layer 2*a* and the second phosphor layer 2*b*, by controlling the ratio of coating weights thereof ($CW_1$:$CW_2$) within an appropriate range, can further improve the sharpness and granularity. In concrete, when the coating weight per unit area of phosphor particles in the first phosphor layer 2*a* is $CW_1$ and the coating weight per unit area of phosphor particles in the second phosphor layer 2*b* is $CW_2$, the ratio ($CW_1$:$CW_2$) of these $CW_1$ and $CW_2$ is preferable to be in the range of 8:2 to 6:4.

Figure 4:
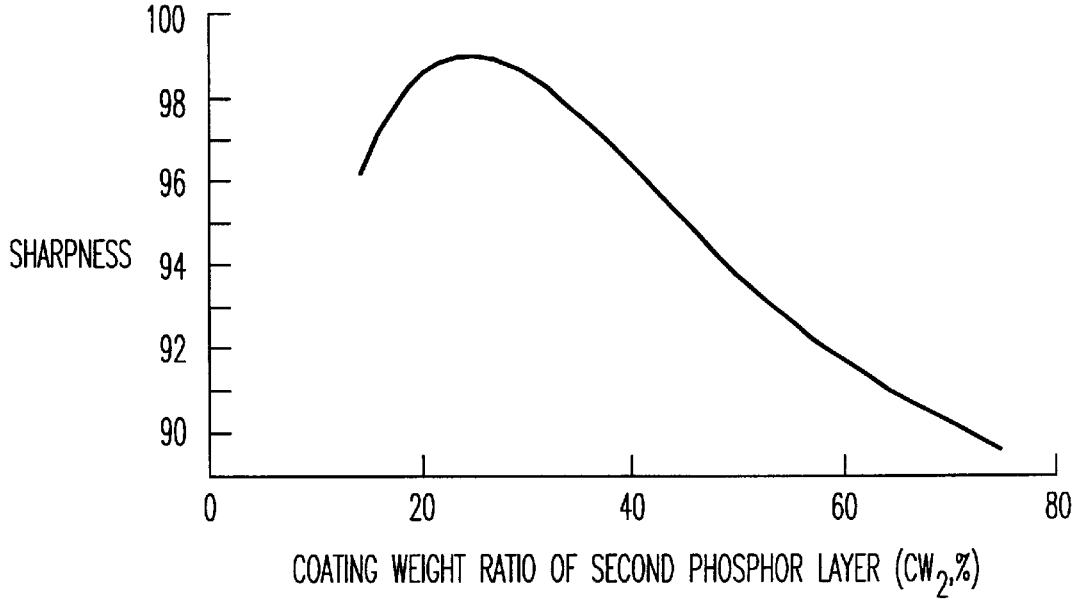
FIG. 4 is a diagram showing one example of sharpness performance when the ratio of phosphor coating weights of the first phosphor layer and the second phosphor layer ($CW_1$:$CW_2$) is varied in the intensifying screen shown in FIG. 1.

FIG. 4 shows one example of sharpness performance when the ratio of coating weights of the first phosphor layer 2*a* and the second phosphor layer 2*b* is varied. In FIG. 4, the ratio of coating weights of phosphor is shown with the ratio (%) of the coating weight of the second phosphor layer 2*b* to the total coating weight of phosphor of the phosphor layer 2. In FIG. 4, $Gd_2O_2S$:Tb phosphor particles are employed. Average particle diameter $D_1$ of phosphor particles constituting the first phosphor layer 2*a* is 2 $\mu$m, average particle diameter $D_2$ of phosphor particles constituting the second phosphor layer 2*b* is 9 $\mu$m, and the total coating weight per unit area of phosphor particles of the phosphor layer 2 is 0.60 kg/m$^2$. In FIG. 4, such intensifying screen 4 is employed as the front screen.

As obvious from FIG. 4, when the ratio of coating weights of phosphor of the first phosphor layer 2*a* and the second phosphor layer 2*b* ($CW_1$:$CW_2$) is in the range of 8:2 to 6:4, excellent sharpness can be obtained. The same is with the granularity. When the intensifying screen 4 is employed for the back screen, similar tendency can be observed.

Thus, by forming a phosphor layer 2 in two-layer structure ($D_1$<$D_2$) consisting of the first phosphor layer 2*a* and the second phosphor layer 2*b* of phosphor particles of different average particle sizes, and by further setting average particle diameters $D_1$ and $D_2$, particle size distribution, the ratio of coating weights ($CW_1$:$CW_2$) of the first phosphor layer 2*a* and the second phosphor layer 2*b*, or the like in appropriate ranges, excellent sensitivity and sharpness can be obtained, and in addition granularity can be improved. The phosphor layers 2 of two-layer structure can be manufactured in the identical manner with the ordinary phosphor layers. Accordingly, mass-productivity of the intensifying screens 4 can be fully satisfied. In addition, intended performance can be obtained with reproducibility.

The intensifying screens of the aforementioned mode can be produced in the following manner.

That is, smaller size phosphor of which average particle diameter is $D_1$ and range coefficient $k_1$ is in the range of from 1.3 to 1.8 is mixed with an appropriate amount of binder. Organic solvent is added thereto to prepare a coating liquid of smaller particle size phosphor of appropriate viscosity. This coating liquid is used for preparation of the first phosphor layer 2*a*. On the other hand, larger size phosphor of which average particle diameter is $D_2$ (>$D_1$) and range coefficient $k_2$ is in the range of 1.5 to 2.0 is mixed with an appropriate amount of binder. Organic solvent is added thereto to prepare a coating liquid of larger particle size phosphor of appropriate viscosity. This coating liquid is used to prepare the second phosphor layer 2*b*.

The coating liquid of smaller particle size phosphor being used for preparation of the first phosphor layer 2*a* is coated on a support 1 by the use of knife coating or roller coating, followed by drying, to form a first phosphor layer 2*a*. Next, on the first phosphor layer 2*a*, the coating liquid of larger size phosphor being used for preparation of the second phosphor layer 2*b* is coated by the use of knife coating or roller coating, followed by drying, to form a second phosphor layer 2*b*.

Incidentally, in some cases, there are intensifying screens of a structure in which light reflection layer, light absorption layer, layer of metallic foil or the like is disposed between a support 1 and a phosphor layer 2. In that case, the light reflection layer, light absorption layer, layer of metallic foil or the like can be formed in advance on the support 1, and thereon the phosphor layer 2 needs only be formed.

As binders being employed for preparation of phosphor coating liquid, existing ones such as nitrocellulose, cellulose acetate, ethyl cellulose, polyvinyl butyral, flocculate polyester, polyvinyl acetate, vinylidene chloride-vinyl chloride copolymer, vinyl chloride-vinyl acetate copolymer, polyalkyl (metha) acrylate, polycarbonate, polyurethane, cellulose acetate butyrate, polyvinyl alcohol or the like can be cited. As organic solvents, for instance, ethanol, methyl ethyl ether, butyl acetate, ethyl acetate, ethyl ether, xylene or the like can be cited. By the way, to the phosphor coating liquid, dispersion agents such as phthalic acid, stearic acid or the like and plasticizers such as triphenyl phosphate, diethyl phthalate or the like can be added.

For the support 1, for instance, such resins as cellulose acetate, cellulose propionate, cellulose acetate butyrate, polyesters such as polyethylene terephthalate, polystyrene, polymethyl methacrylate, polyamide, polyimide, vinyl chloride-vinyl acetate copolymer, polycarbonate or the like can be formed in film to use.

A protective film consisting of transparent resinous film of such as polyethylene terephthalate, polyethylene, polyvinylidene chloride, polyamide or the like is laminated on the aforementioned phosphor layer 2 of two layer structure to form an intended intensifying screen 4.

The protective film 3 may be formed by dissolving resins such as cellulose derivatives such as cellulose acetate, nitrocellulose, cellulose acetate butyrate or the like, polyvinyl chloride, polyvinyl acetate, polycarbonate, polyvinyl butyral, polymethyl methacrylate, polyvinyl formal, polyurethane or the like in solvent to form protective film coating liquid of appropriate viscosity, followed by coating and drying thereof.

Figure 5:
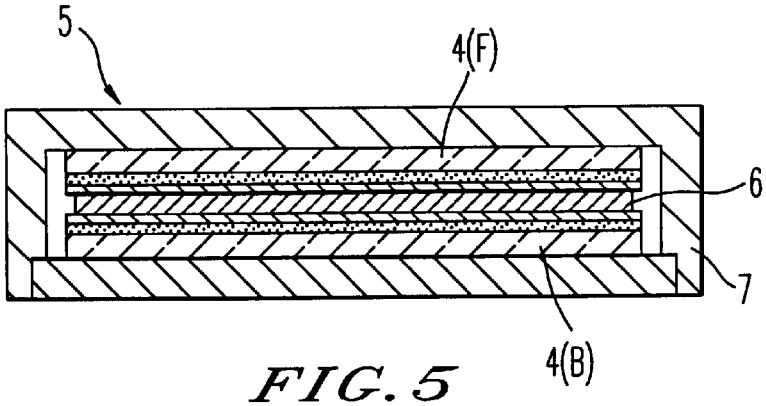
FIG. 5 is a cross section showing a schematic structure of one embodiment of a radiation receptor of the present invention.

The intensifying screen 4 such as described above is used as radiation receptor 5 such as shown in FIG. 5 in radiography such as X-ray photography. In the radiation receptor 5 shown in FIG. 5, radiation film 6 such as X-ray film is interposed between two sheets of intensifying screen 4 (the intensifying screen 4 having the phosphor layer 2 of two-layer structure due to the aforementioned mode) and is accommodated in a cassette 7 in this state.

Among the aforementioned two sheets of intensifying screen 4, one 4 that is disposed at subject side is so-called front-screen F, and the other one 4 is so-called back-screen B. The intensifying screens 4 to be used for the front intensifying screen F and back intensifying screen B have a basically identical structure as described in the aforementioned embodiment. When the total coating weight per unit area of phosphor particles in the phosphor layer 2 of two layer structure of the front intensifying screen F (summation of coating weights of phosphor particles of the first and second phosphor layers 2*a* and 2*b*) is $TCW_f$ and the total coating weight per unit area of phosphor particles in the phosphor layer 2 of two layer structure of the back screen B is $TCW_b$, the ratio of $TCW_f$ and $TCW_b$ ($TCW_f$:$TCW_b$) is preferable to be in the range of 3:7 to 4:6.

Figure 6:
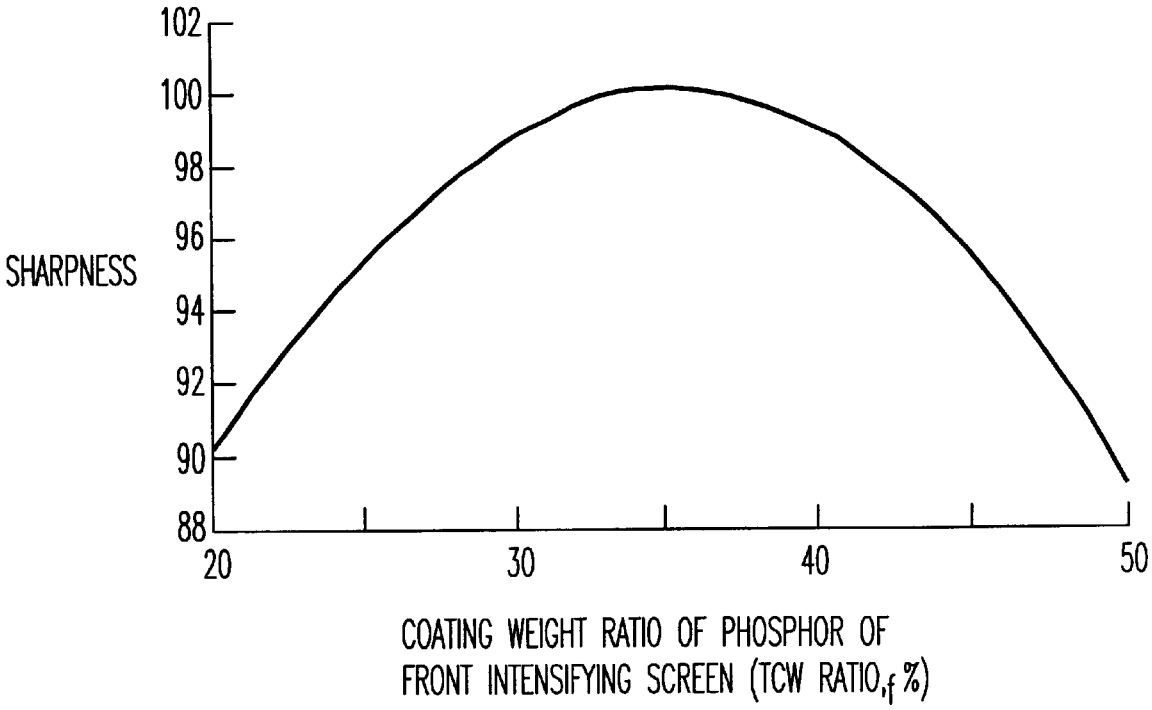
FIG. 6 is a diagram showing one example of sharpness performance when the ratio of total coating weights per unit area of phosphor particles of a front intensifying screen and a back intensifying screen ($TCW_f$:$TCW_b$) is varied.

FIG. 6 shows one example of sharpness performance when the ratio of total coating weight per unit area ($TCW_f$ ratio) of phosphor particles of the front screen F and that of the back screen B is varied. By the way, in FIG. 6, $Gd_2O_2S$:Tb phosphor is employed. The summation of the total coating weight per unit area of phosphor particles of the front screen F and that of the back screen B is 1.5 kg/m$^2$. As obvious from FIG. 6, when the ratio of the total coating weight per unit area of phosphor particles of the front screen F and that of the back screen B ($TCW_f$:$TCW_b$) is in the range of 3:7 to 4:6, excellent sharpness can be obtained.

Figure 7:
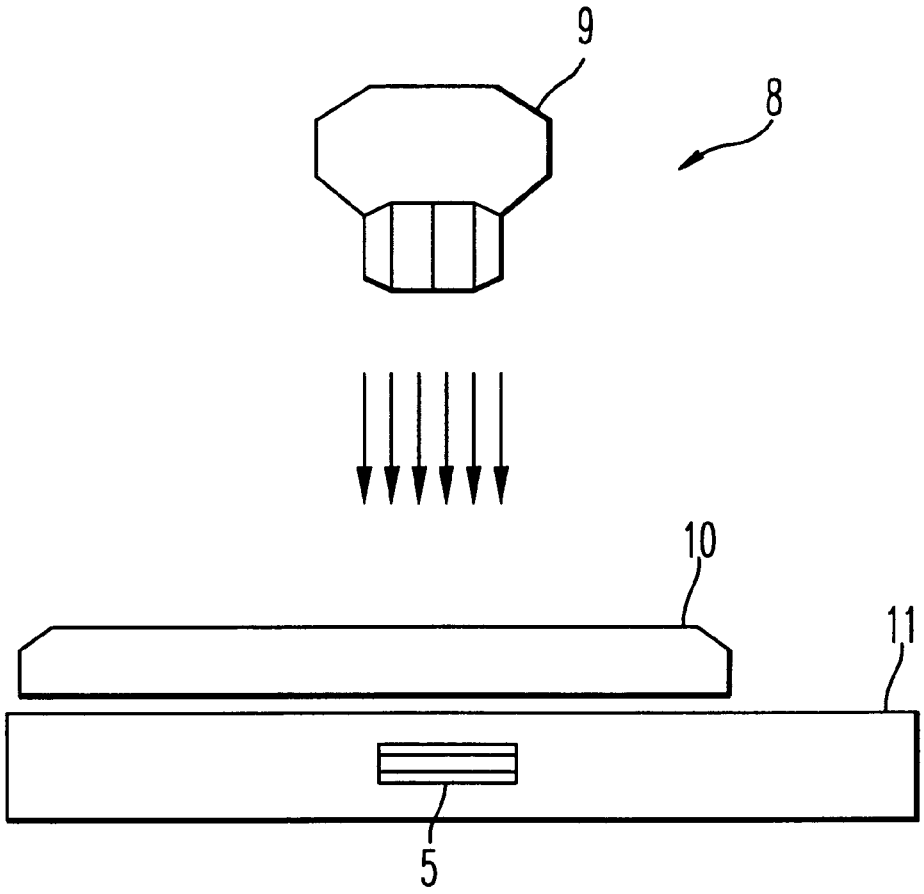
FIG. 7 is a diagram showing diagrammatically a constitution of one embodiment of a radiation inspection device of the present invention.

The radiation receptor 5 such as described above is used in a radiation inspection device 8 such as shown in FIG. 7. The radiation inspection device 8 shown in FIG. 7 comprises radiation source 9 and table 11 disposed opposite to the radiation source through subject 10 to be inspected such as a patient. The radiation receptor 5 is inserted into the table 11 from the side of the table 11 to use. At this time, the radiation receptor 5 is inserted so that the front screen F is disposed at the subject 10 side.

The radiation receptor 5 constituted of the intensifying screen 4 of the aforementioned embodiment and the radiation inspection device 8 to be used therewith, even when X-ray exposure to an subject is reduced through improvement of system speed, can give excellent recognizability. That is, when used for medical X-ray radiography, for instance, amount of X-ray exposure to a subject can be reduced and excellent diagnosis can be carried out. When used in industrial nondestructive inspection or the like, in addition to reduction of an amount of X-rays, inspection accuracy can be improved.

Next, concrete embodiments of intensifying screens of the aforementioned modes and evaluation results thereof will be explained.

EMBODIMENT 1

First, 10 parts by weight of $Gd_2O_2S$:Tb phosphor powder of which average particle diameter is 3 μm and range coefficient k of particle size distribution is 1.62 is combined with 1 part by weight of vinyl chloride-vinyl acetate copolymer as binder and an appropriate amount of ethyl acetate as organic solvent to prepare a coating liquid of smaller particle size phosphor. Similarly, 10 parts by weight of $Gd_2O_2S$:Tb phosphor particles of which average particle diameter is 9 μm and range coefficient k of particle size distribution is 1.70 is combined with 1 part by weight of vinyl chloride-vinyl acetate copolymer as binder and an appropriate amount of ethyl acetate as organic solvent to prepare a coating liquid of larger size phosphor.

Then, first, the aforementioned coating liquid of smaller size phosphor is coated uniformly on a support by the use of knife coating to be a phosphor coating weight of 0.40 kg/m$^2$ after drying, followed by drying to form a first phosphor layer consisting of smaller particle size phosphor. The support consists of polyethylene terephthalate film in which carbon black is kneaded and of which thickness is 250 μm. Then, on the first phosphor layer, the coating liquid of larger size phosphor is coated uniformly by the use of knife coating to be a phosphor coating weight of 0.20 kg/m$^2$ after drying, followed by drying to form a second phosphor layer consisting of larger size phosphor. Thereafter, on the aforementioned phosphor layer of two layer structure, a protective film of a thickness of 9 μm is laminated. Thus, first, a front intensifying screen is prepared.

On the other hand, the aforementioned coating liquid of smaller size phosphor is coated uniformly on a support by the use of knife coating to be a phosphor coating weight of 0.55 kg/m$^2$ after drying, followed by drying to form a first phosphor layer consisting of smaller size phosphor. The support consists of polyethylene terephthalate film in which carbon black is kneaded and of which thickness is 250 μm. Then, on the first phosphor layer, the coating liquid of larger size phosphor is coated uniformly by the use of knife coating method to be a phosphor coating weight of 0.30 kg/m$^2$ after drying, followed by drying to form a second phosphor layer consisting of larger size phosphor. Thereafter, on the aforementioned phosphor layer of two layer structure, a protective film of a thickness of 9 μm is laminated. Thus, a back intensifying screen is prepared.

In the intensifying screens for the front and back intensifying screens, the ratio of coating weights $CW_1$:$CW_2$ of the front intensifying screen is 6.7:3.3 and for the back intensifying screen, $CW_1$:$CW_2$ is 6.5:3.5. In addition, the ratio of the total phosphor coating weights of the front screen and back screen $TCW_f$:$TCW_b$ is 4.1:5.9. Such front and back intensifying screens are provided for performance evaluation.

Comparative Example 1

10 parts by weight of $Gd_2O_2S$:Tb phosphor powder of which average particle diameter is 6.5 μm and range coefficient k of particle size distribution is 1.55 is combined with 1 part by weight of vinyl chloride-vinyl acetate copolymer as binder and an appropriate amount of ethyl acetate as organic solvent to prepare a coating liquid of phosphor. The aforementioned coating liquid of phosphor is coated uniformly on a support by the use of knife coating to be a phosphor coating weight of 0.45 kg/m$^2$ after drying, followed by drying to form a phosphor layer. The support consists of polyethylene terephthalate film in which titanium white is kneaded and of which thickness is 250 μm. Thereafter, on the phosphor layer of one layer structure, a protective film of a thickness of 9 μm is laminated. Thus, a front intensifying screen is prepared.

On the other hand, on a support consisting of polyethylene terephthalate film in which titanium white is kneaded and of which thickness is 250 μm, the aforementioned phosphor coating liquid is coated uniformly by the use of knife coating to be phosphor coating weight of 0.55 kg/m$^2$ after drying, followed by drying to form a phosphor layer. Thereafter, on the phosphor layer of one layer structure, a protective film of a thickness of 9 μm is laminated. Thus, a back intensifying screen is prepared. These front and back intensifying screens are provided for the performance evaluation that will be described later.

Comparative Example 2

In the aforementioned embodiment 1, for the smaller size phosphor, $Gd_2O_2S$:Tb phosphor powder of which average particle diameter is 3 μm and range coefficient k of particle size distribution is 1.13 is employed, and for the larger size phosphor, $Gd_2O_2S$:Tb phosphor powder of which average particle diameter is 9 μm and range coefficient k of particle size distribution is 1.40 is employed. Except for the above, in the identical way with the embodiment 1, the front and back intensifying screens are prepared. Such front and back intensifying screens are provided for the performance evaluation that will be described later.

EMBODIMENT 2

First, 10 parts by weight of $Gd_2O_2S$:Tb phosphor powder of which average particle diameter is 3 μm and range coefficient k of particle size distribution is 1.62 is combined with 1 part by weight of vinyl chloride-vinyl acetate copolymer as binder and an appropriate amount of ethyl acetate as organic solvent to prepare a coating liquid of smaller size phosphor. Similarly, 10 parts by weight of $Gd_2O_2S$:Tb phosphor powder of which average particle diameter is 9 μm and range coefficient k of particle size distribution is 1.70 is combined with 1 part by weight of vinyl chloride-vinyl acetate copolymer as binder and an appropriate amount of ethyl acetate as organic solvent to prepare a coating liquid of larger size phosphor.

Then, first, the aforementioned coating liquid of smaller size phosphor is coated uniformly on a support by the use of knife coating to be a phosphor coating weight of 0.40 kg/m$^2$ after drying, followed by drying to form a first phosphor layer consisting of smaller size phosphor. The support consists of polyethylene terephthalate film in which titanium white is kneaded and of which thickness is 250 μm. Then, on the first phosphor layer, the coating liquid of larger size phosphor is coated uniformly by the use of knife coating to be a phosphor coating weight of 0.20 kg/m$^2$ after drying, followed by drying to form a second phosphor layer consisting of larger size phosphor. Thereafter, on the aforementioned phosphor layer of two layer structure, a protective film of a thickness of 9 $\mu$m is laminated. Thus, first, a front intensifying screen is prepared.

On the other hand, the aforementioned coating liquid of smaller size phosphor is coated uniformly on a support by the use of knife coating to be a phosphor coating weight of 0.70 kg/m$^2$ after drying, followed by drying to form a first phosphor layer consisting of smaller size phosphor. The support consists of polyethylene terephthalate film in which titanium white is kneaded and of which thickness is 250 $\mu$m. Then, on the first phosphor layer, the coating liquid of larger size phosphor is coated uniformly by the use of knife coating to be a phosphor coating weight of 0.35 kg/m$^2$ after drying, followed by drying to form a second phosphor layer consisting of larger size phosphor. Thereafter, on the aforementioned phosphor layer of two layer structure, a protective film of a thickness of 9 $\mu$m is laminated. Thus, a back intensifying screen is prepared.

In the front and back intensifying screens, the ratio of coating weights $CW_1$:$CW_2$ of the front intensifying screen is 6.7:3.3 and of the back intensifying screen, $CW_1$:$CW_2$ is 6.7:3.3. In addition, the ratio of the total phosphor coating weights of the front screen and back screen $TCW_f$:$TCW_b$ is 3.6:6.4. Such front and back intensifying screens are provided for performance evaluation that will be described later.

Comparative Example 3

10 parts by weight of $Gd_2O_2S$:Tb phosphor powder of which average particle diameter is 10.8 $\mu$m and range coefficient k of particle size distribution is 1.60 is combined with 1 part by weight of vinyl chloride-vinyl acetate copolymer as binder and an appropriate amount of ethyl acetate as organic solvent to prepare a coating liquid of phosphor. The aforementioned coating liquid of phosphor is coated uniformly on a support by the use of knife coating to be a phosphor coating weight of 0.55 kg/m$^2$ after drying, followed by drying to form a phosphor layer. The support consists of polyethylene terephthalate film in which titanium white is kneaded and of which thickness is 250 $\mu$m. Thereafter, on the phosphor layer of one layer structure, a protective film of a thickness of 9 $\mu$m is laminated. Thus, a front intensifying screen is prepared.

On the other hand, on a support consisting of polyethylene terephthalate film in which titanium white is kneaded and of which thickness is 250 $\mu$m, the aforementioned coating liquid of phosphor is coated uniformly by the use of knife coating to be a phosphor coating weight of 1.15 kg/m$^2$ after drying, followed by drying to form a phosphor layer. Thereafter, on the phosphor layer of one layer structure, a protective film of a thickness of 9 $\mu$m is laminated. Thus, a front intensifying screen is prepared. These front and back intensifying screens are provided for the performance evaluation that will be described later.

Comparative Example 4

In the aforementioned embodiment 2, for the smaller particle size phosphor, $Gd_2O_2S$:Tb phosphor powder of which average particle diameter is 3 $\mu$m and range coefficient k of particle size distribution is 1.95 is employed, and for the larger size phosphor, $Gd_2O_2S$:Tb phosphor powder of which average particle diameter is 9 $\mu$m and range coefficient k of particle size distribution is 2.10 is employed. Except for the above, in the identical way with the embodiment 2, front and back intensifying screens are prepared. Such intensifying screens for the uses of front and back screens are provided for the performance evaluation that will be described later.

EMBODIMENT 3

First, 10 parts by weight of $CaWO_4$ phosphor powder of which average particle diameter is 3.5 $\mu$m and range coefficient k of particle size distribution is 1.53 is combined with 1 part by weight of vinyl chloride-vinyl acetate copolymer as binder and an appropriate amount of ethyl acetate as organic solvent to prepare a coating liquid of smaller size phosphor. Similarly, 10 parts by weight of $CaWO_4$ phosphor powder of which average particle diameter is 15.7 $\mu$m and range coefficient k of particle size distribution is 1.65 is combined with 1 part by weight of vinyl chloride-vinyl acetate copolymer as binder and an appropriate amount of ethyl acetate as organic solvent to prepare a coating liquid of larger size phosphor.

Then, first, the aforementioned coating liquid of smaller size phosphor is coated uniformly on a support by the use of knife coating to be a phosphor coating weight of 0.30 kg/m$^2$ after drying, followed by drying to form a first phosphor layer consisting of smaller size phosphor. The support consists of polyethylene terephthalate film in which carbon black is kneaded and of which thickness is 250 $\mu$m. Then, on the first phosphor layer, the coating liquid of larger size phosphor is coated uniformly by the use of knife coating to be a phosphor coating weight of 0.20 kg/m$^2$ after drying, followed by drying to form a second phosphor layer consisting of larger size phosphor. Thereafter, on the aforementioned phosphor layer of two layer structure, a protective film of a thickness of 9 $\mu$m is laminated. Thus, first, a front intensifying screen is prepared.

On the other hand, the aforementioned coating liquid of smaller size phosphor is coated uniformly on a support by the use of knife coating to be a phosphor coating weight of 0.50 kg/m$^2$ after drying, followed by drying to form a first phosphor layer consisting of smaller size phosphor. The support consists of polyethylene terephthalate film in which carbon black is kneaded and of which thickness is 250 $\mu$m. Then, on the first phosphor layer, the coating liquid of larger size phosphor is coated uniformly by the use of knife coating to be a phosphor coating weight of 0.30 kg/m$^2$ after drying, followed by drying to form a second phosphor layer consisting of larger size phosphor. Thereafter, on the aforementioned phosphor layer of two layer structure, a protective film of a thickness of 9 $\mu$m is laminated. Thus, a back intensifying is prepared.

In the front and back intensifying screens, the ratio of phosphor coating weights $CW_1$:$CW_2$ of the front intensifying screen is 6:4 and of the back intensifying screen, $CW_1$:$CW_2$ is 6.3:3.7. In addition, the ratio of the total phosphor coating weights of the front screen and back screen $TCW_f$:$TCW_b$ is 3.8:6.2. Such front and back intensifying screens are provided for performance evaluation that will be described later.

Comparative Example 5

10 parts by weight of $CaWO_4$ phosphor powder of which average particle diameter is 10.0 $\mu$m and range coefficient k of particle size distribution is 1.40 is combined with 1 part by weight of vinyl chloride-vinyl acetate copolymer as binder and an appropriate amount of ethyl acetate as organic solvent to prepare a coating liquid of phosphor. The aforementioned coating liquid of phosphor is coated uniformly on a support by the use of knife coating to be a phosphor coating weight of 0.60 kg/m$^2$ after drying, followed by drying to form a phosphor layer. The support consists of polyethylene terephthalate film in which titanium white is kneaded and of which thickness is 250 $\mu$m. Thereafter, on the phosphor layer of one layer structure, a protective film of a thickness of 9 $\mu$m is laminated. Thus, a front intensifying is prepared.

On the other hand, on a support consisting of polyethylene terephthalate film in which titanium white is kneaded and of which thickness is 250 $\mu$m, the aforementioned coating liquid of phosphor is coated uniformly by the use of knife coating to be a phosphor coating weight of 0.90 kg/m$^2$ after drying, followed by drying to form a phosphor layer. Thereafter, on the phosphor layer of one layer structure, a protective film of a thickness of 9 $\mu$m is laminated. Thus, a front intensifying screen is prepared. These front and back intensifying screens are provided for the performance evaluation that will be described later.

Comparative Example 6

In the aforementioned embodiment 3, for the smaller size phosphor, $CaWO_4$ phosphor powder of which average particle diameter is 3.5 $\mu$m and range coefficient k of particle size distribution is 1.20 is employed, and for the larger size phosphor, $CaWO_4$ phosphor powder of which average particle diameter is 15.7 $\mu$m and range coefficient k of particle size distribution is 1.45 is employed. Except for the above, in the identical way with the embodiment 3, front and back intensifying screens are prepared. Such front and back intensifying screens are provided for the performance evaluation that will be described later.

EMBODIMENT 4

First, 10 parts by weight of BaFCl:Eu phosphor powder of which average particle diameter is 3.8 $\mu$m and range coefficient k of particle size distribution is 1.58 is combined with 1 part by weight of vinyl chloride-vinyl acetate copolymer as binder and an appropriate amount of ethyl acetate as organic solvent to prepare a coating liquid of smaller size phosphor. Similarly, 10 parts by weight of BaFCl:Eu phosphor powder of which average particle diameter is 8.5 $\mu$m and range coefficient k of particle size distribution is 1.65 is combined with 1 part by weight of vinyl chloride-vinyl acetate copolymer as binder and an appropriate amount of ethyl acetate as organic solvent to prepare a coating liquid of larger size phosphor.

Then, first, the aforementioned coating liquid of smaller size phosphor is coated uniformly on a support by the use of knife coating to be a phosphor coating weight of 0.30 kg/m$^2$ after drying, followed by drying to form a first phosphor layer consisting of smaller size phosphor. The support consists of polyethylene terephthalate film in which titanium white is kneaded and of which thickness is 250 $\mu$m. Then, on the first phosphor layer, the coating liquid of larger size phosphor is coated uniformly by the use of knife coating to be a phosphor coating weight of 0.20 kg/m$^2$ after drying, followed by drying to form a second phosphor layer consisting of larger size phosphor. Thereafter, on the aforementioned phosphor layer of two layer structure, a protective film of a thickness of 9 $\mu$m is laminated. Thus, front and back intensifying screens are prepared.

In the front and back intensifying screens, the ratio of coating weights $CW_1$:$CW_2$ of the front intensifying screen and back intensifying screen is 6:4. In addition, the ratio of the total phosphor coating weights of the front screen and back screen $TCW_f$:$TCW_b$ is 5:5. Such front and back intensifying screens are provided for performance evaluation that will be described later.

Comparative Example 7

10 parts by weight of BaFCl:Eu phosphor powder of which average particle diameter is 4.5 $\mu$m and range coefficient k of particle size distribution is 1.50 is combined with 1 part by weight of vinyl chloride-vinyl acetate copolymer as binder and an appropriate amount of ethyl acetate as organic solvent to prepare a coating liquid of phosphor. The coating liquid of phosphor is coated uniformly on a support by the use of knife coating to be a phosphor coating weight of 0.50 kg/m$^2$ after drying, followed by drying to form a phosphor layer. The support consists of polyethylene terephthalate film in which titanium white is kneaded and of which thickness is 250 $\mu$m. Thereafter, on the phosphor layer of one layer structure, a protective film of a thickness of 9 $\mu$m is laminated. Thus, front and back intensifying screens are prepared. These front and back intensifying screens are provided for performance evaluation that will be described later.

Comparative Example 8

In the aforementioned embodiment 4, for the smaller size phosphor, BaFCl:Eu phosphor powder of which average particle diameter is 3.8 $\mu$m and range coefficient k of particle size distribution is 1.85 is employed, and for the larger size phosphor, BaFCl:Eu phosphor powder of which average particle diameter is 8.5 $\mu$m and range coefficient k of particle size distribution is 1.40 is employed. Except for the above, in the identical way with the embodiment 4, front and back intensifying screens are prepared. Such front and back intensifying screens are provided for the performance evaluation that will be described later.

The respective intensifying screen pairs (pair of a front intensifying screen and a back intensifying screen) due to the aforementioned Embodiments 1 and 2, and Comparative Examples 1, 2, 3 and 4 are evaluated of their sensitivity, sharpness and granularity with ortho-type X-ray film (product name of Konica: SR-G). The respective intensifying screen pairs due to the aforementioned Embodiments 3 and 4, and Comparative Examples 5, 6, 7 and 8 are evaluated of their sensitivity, sharpness and granularity with regular-type X-ray film (product name of Konica: New-A). The results thereof are shown in Table 1.

By the way, photographic performance of the aforementioned intensifying screen pairs is evaluated of sensitivity, sharpness and granularity with X-rays of tube-voltage of 120 kV after transmission of a water phantom of a thickness of 100 mm. The sensitivity is expressed in terms of relative value with each value of comparative example 1, 3, 5 and 7 as 100, respectively. The sharpness, after evaluating the respective MTFs at a spatial frequency of 2 lines/mm, is expressed in terms of relative values with each value of comparative examples 1, 3, 5 and 7 as 100, respectively. The granularity is expressed as relative RMS value at a spatial frequency of 3.12 line/mm under photographic density of 1.0.

TABLE 1

| | Kind of phosphor | Phosphor layer structure of front F and back B | Thickness of protective film (μm) | Support | Sensitivity (%) | Sharpness (%) | Relative RMS (%) |
|---|---|---|---|---|---|---|---|
| Embodiment 1 | $Gd_2O_2S$:Tb | F:3 μm (k = 1.62), 0.40 kg/m$^2$ /9 μm (k = 1.70), 0.20 kg/m$^2$ | 9 | carbon black | 120 | 120 | 130 |
| | | B:3 μm (k = 1.62), 0.55 kg/m$^2$ /9 μm (k = 1.70), 0.30 kg/m$^2$ | 9 | carbon black | | | |
| Comparative example 1 | $Gd_2O_2S$:Tb | F:6.5 μm, 0.50 kg/m$^2$ | 9 | titanium white | 100 | 100 | 100 |
| | | B:6.5 μm, 0.55 kg/m$^2$ | 9 | titanium white | | | |
| Comparative example 2 | $Gd_2O_2S$:Tb | F:3 μm (k = 1.13), 0.40 kg/m$^2$ /9 μm (k = 1.40), 0.20 kg/m$^2$ | 9 | carbon black | 121 | 108 | 125 |
| | | B:3 μm (k = 1.13), 0.55 kg/m$^2$ /9 μm (k = 1.40), 0.30 kg/m$^2$ | 9 | carbon black | | | |
| Embodiment 2 | $Gd_2O_2S$:Tb | F:3 μm (k = 1.62), 0.40 kg/m$^2$ /9 μm (k = 1.70), 0.20 kg/m$^2$ | 9 | titanium white | 90 | 140 | 110 |
| | | B:3 μm (k = 1.62), 0.70 kg/m$^2$ /9 μm (k = 1.70), 0.35 kg/m$^2$ | 9 | titanium white | | | |
| Comparative example 3 | $Gd_2O_2S$:Tb | F:10.8 μm, 0.55 kg/m$^2$ | 9 | titanium white | 100 | 100 | 100 |
| | | F:10.8 μm, 1.15 kg/m$^2$ | 9 | titanium white | | | |
| Comparative example 4 | $Gd_2O_2S$:Tb | F:3 μm (k = 1.95), 0.40 kg/m$^2$ /9 μm (k = 2.10), 0.20 kg/m$^2$ | 9 | titanium white | 85 | 120 | 112 |
| | | B:3 μm (k = 1.95), 0.70 kg/m$^2$ /9 μm (k = 2.10), 0.35 kg/m$^2$ | 9 | titanium white | | | |

TABLE 2

| | Kind of phosphor | Phosphor layer structure of front F and back B | Thickness of protective film (μm) | Support | Sensitivity (%) | Sharpness (%) | Relative RMS (%) |
|---|---|---|---|---|---|---|---|
| Embodiment 3 | $CaWO_4$ | F:3.5 μm (k = 1.53), 0.30 kg/m$^2$ /15.7 μm (k = 1.65), 0.20 kg/m$^2$ | 9 | carbon black | 100 | 115 | 110 |
| | | B:3.5 μm (k = 1.53), 0.50 kg/m$^2$ /15.7 μm (k = 1.65), 0.30 kg/m$^2$ | 9 | carbon black | | | |
| Comparative example 5 | $CaWO_4$ | F:10.0 μm, 0.60 kg/m$^2$ | 9 | carbon black | 100 | 100 | 100 |
| | | B:10.0 μm, 0.90 kg/m$^2$ | 9 | titanium white | | | |
| Comparative example 6 | $CaWO_4$ | F:3.5 μm (k = 1.20), 0.30 kg/m$^2$ /15.7 μm (k = 1.45), 0.20 kg/m$^2$ | 9 | carbon black | 100 | 106 | 108 |
| | | B:3.5 μm (k = 1.20), 0.50 kg/m$^2$ /15.7 μm (k = 1.45), 0.30 kg/m$^2$ | 9 | carbon black | | | |
| Embodiment 4 | BaFCl:Eu | F:3.8 μm (k = 1.58), 0.30 kg/m$^2$ /8.5 μm (k = 1.65), 0.20 kg/m$^2$ | 9 | titanium white | 110 | 110 | 120 |
| | | B:3.8 μm (k = 1.58), 0.30 kg/m$^2$ /8.5 μm (k = 1.65), 0.20 kg/m$^2$ | 9 | titanium white | | | |
| Comparative example 7 | BaFCl:Eu | F:4.5 μm, 0.50 kg/m$^2$ | 9 | titanium white | 100 | 100 | 100 |
| | | B:4.5 μm, 0.50 kg/m$^2$ | 9 | carbon black | | | |
| Comparative example 8 | BaFCl:Eu | F:3.8 μm (k = 1.85), 0.30 kg/m$^2$ /8.5 μm (k = 1.40), 0.20 kg/m$^2$ | 9 | titanium white | 111 | 103 | 120 |
| | | B:3.8 μm (k = 1.85), 0.30 kg/m$^2$ /8.5 μm (k = 1.40), 0.20 kg/m$^2$ | 9 | titanium white | | | |

As obvious from Tables 1 and 2, all of the respective intensifying screen pairs (pair of a front intensifying screen and a back intensifying screen) due to Embodiments 1 through 4, compared with intensifying screen pairs of single layer structure, are improved in their granularity. In addition to this improvement, lowering of sensitivity or sharpness is small or improved.

Next, another embodiments for implementing intensifying screens of the present invention will be described.

Figure 8:
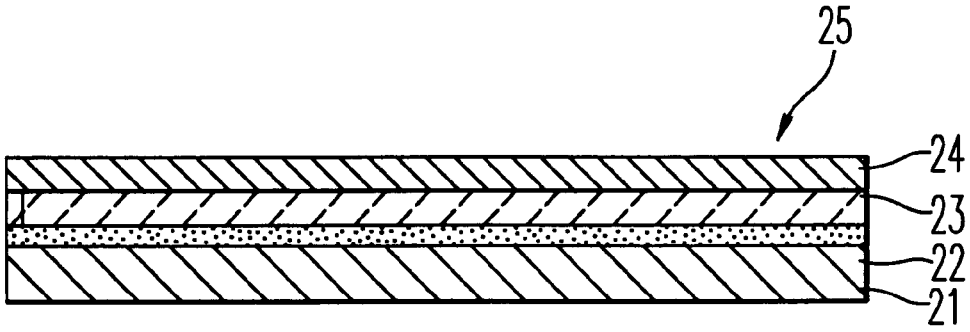
FIG. 8 is a cross section showing an essential structure of one embodiment of another intensifying screen of the present invention.
Figure 9:
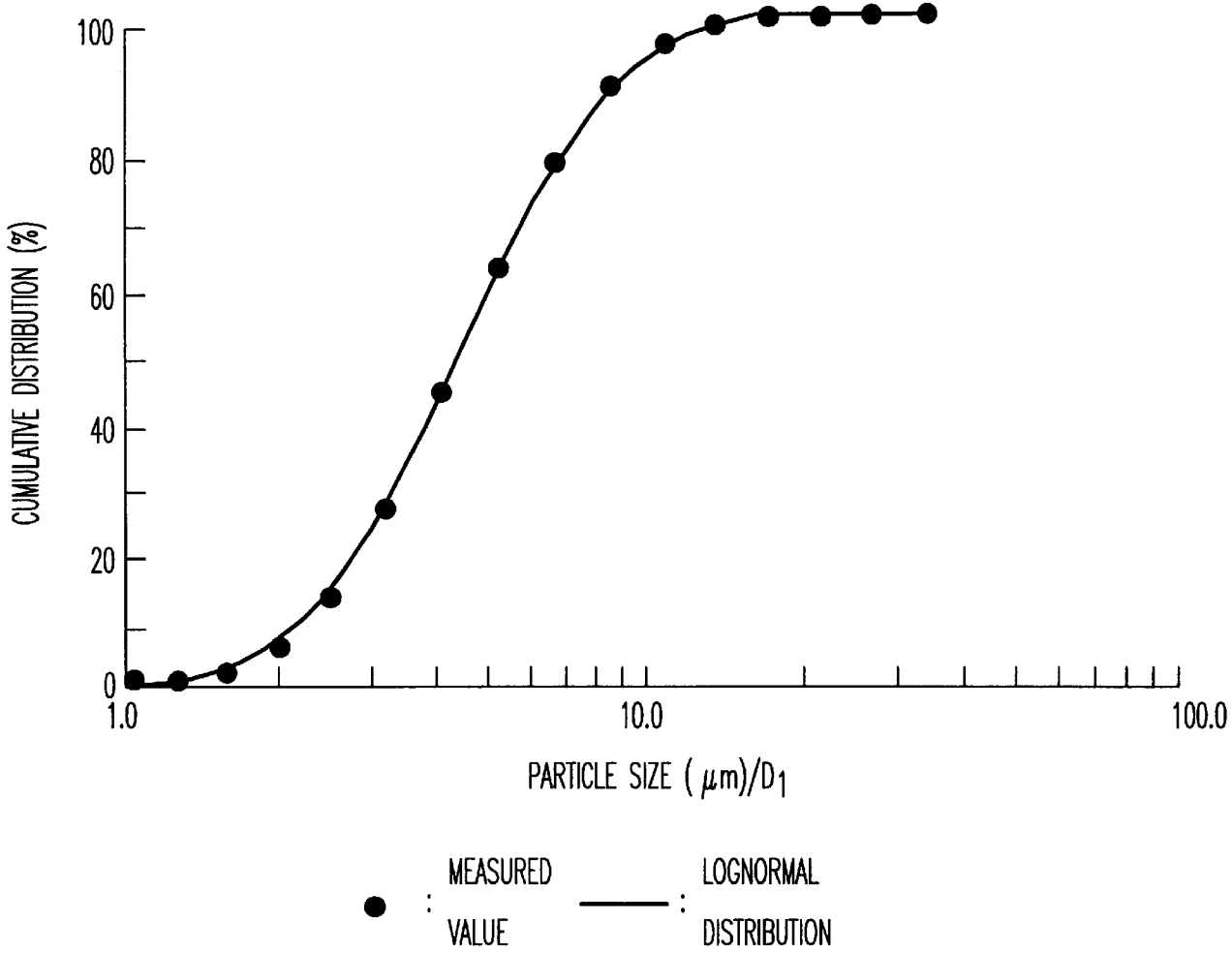
FIG. 9 is a diagram showing one example of a cumulative particle size distribution of phosphor (in terms of weight) employed in an intensifying screen of the present invention.

FIG. 8 is a cross section showing a structure of one embodiment of a third intensifying screen of the present invention. In the same figure, reference numeral 21 denotes a support consisting of plastic film or nonwoven fabric. On one surface the support 21, there is disposed a powder layer 22. The powder layer consists of at least one kind of particles selected from particles of simple metal, particles of alloy consisting mainly of metal and particles of compound consisting mainly of metal and has a thickness of 2 to 40 kg/m$^2$ in terms of weight per unit area.

The powder layer 22, as will be explained in detail later, is disposed so as to absorb X-rays of high energy to be the intensity of the X-rays of high energy appropriate for the sensitivity of X-ray film. Further, the powder layer 22, due to an elimination effect of scattered X-rays and a sensitizing effect of phosphor due to secondary electrons based on Compton scattering, improves sensitivity, sharpness and granularity. Upon obtaining such effects, as the metal constituting the powder layer 22, at least one kind of heavy metal selected from W, Mo, Nb and Ta is preferable.

On the powder layer 22, there is disposed a phosphor layer 23. For the phosphors constituting the phosphor layer 23, generally used $CaWO_4$ may be employed and also rare earth phosphors of high emission efficiency such as BaFCl:Eu, $Gd_2O_2S$:Tb, LaOBr:Tb or the like may be used. The phosphor layer 23 contains particles of such phosphors.

On the phosphor layer 23, a protective film 24 consisting of plastic film or plastic cover film is disposed. With these elements, an X-ray intensifying screen 25 being used in high energy X-ray radiography of 1 MV or more is constituted. The X-ray intensifying screen 25 of this embodiment is suitable for one that is used to confirm an irradiation area prior to treatment with X-rays of high energy for treatment such as approximately 4 MV that is obtained by a linear accelerator called as linac.

For particles constituting the aforementioned powder layer 22, at least one kind of particles selected from simple particles of heavy metals, in particular of W, Mo, Nb, Ta or the like, alloy particles consisting mainly of these metals, and compound particles consisting mainly of these metals can be employed.

In concrete, simple particles of metals such as W particles, Mo particles, Nb particles and Ta particles, alloy particles consisting mainly of heavy metals such as W—Re alloy particles, W—Mo alloy particles, W—Nb alloy particles, W—Ta alloy particles, Mo—Nb alloy particles, Mo—Ta alloy particles and Nb—Ta alloy particles, and compound particles consisting mainly of heavy metals such as particles of tungsten carbide (WC), particles of tungsten oxides (such as $WO_3$ or the like), particles of molybdenum oxides (such as $MoO_3$ or the like), particles of tungsten carbide (MoC), particles of niobium carbide (Nb—C) and particles of tantalum carbide (Ta—C) can be employed. Compounds consisting mainly of refractory metals, without restricting to oxides and carbides, can be various kinds of compounds such as intermetallic compounds or the like, and are not limited to particular types of compounds.

However, when particles of alloys or compounds consisting mainly of heavy metals are employed, alloys or compounds of which amount of heavy metal is 60% or more by weight in these particles are preferable. When the heavy metal is contained less than 60% by weight in the particles, there is a danger that an absorption effect of X-rays of high energy can not be obtained fully. In other words, alloys or compounds of which heavy metal is 60% or more by weight can give an effect similar to that obtained by simple particles of heavy metals.

Heavy metals such as W, Mo, Nb and Ta that are main constituents of the powder layer 22 can largely absorb X-rays of high energy such as described above. Accordingly, when the X-ray intensifying screen 25 of this embodiment is employed for radiography as a preparatory inspection means of X-ray treatment with X-rays of high energy, the high energy X-rays irradiated from the support 21 side, before reaching the phosphor layer 23, is absorbed to the value appropriate for exposure sensitivity of such as X-ray film.

In addition, even if the X-rays converted to an appropriate energy state by going through the powder layer 22 are scattered by the phosphor layer 23 or the protective film 24, the scattered X-rays can be effectively absorbed by the powder layer 22. Thus, by effectively absorbing the scattered X-rays by the powder layer 22, the scattered X-rays can be made less probable in reentering into the phosphor layer 23, the granularity and sharpness can be improved accordingly. Furthermore, since the powder layer 22 consisting mainly of heavy metals such as W or the like has a sensitizing effect of phosphor due to secondary electrons based on Compton scattering, the sensitivity and sharpness can be further improved.

The thickness of the powder layer 22 constituted mainly of heavy metals is in the range of 2 to 40 kg/m$^2$ in terms of weight per unit area. When the thickness of the powder layer 22 is less than 2 kg/m$^2$ in terms of weight per unit area, the X-rays of high energy can not be effectively absorbed, resulting in exposure of less contrast of X-ray film. On the other hand, when the thickness of the powder layer 22 exceeds 40 kg/m$^2$ in terms of weight per unit area, absorption of the X-rays becomes too large, resulting in lowering of sensitivity. The thickness of the powder layer 22 is preferable to be in the range of 5 to 30 kg/m$^2$ in terms of weight per unit area.

The powder layer 22 can be formed in the similar manner with the phosphor layer 23. That is, particles selected from for instance simple particles of W, alloy particles consisting mainly of W or compound particles consisting mainly of W are mixed with adequate amount of binder and organic solvent is added thereto to prepare a powder coating liquid of appropriate viscosity. This powder coating liquid is coated on a support 21 by the use of knife coating or roller coating and dried to result in a desired powder layer 22. According to such coating methods, the powder layer 22 having the aforementioned thickness can be obtained easily and less expensively.

Thus, in the intensifying screen 25, X-rays of high energy are absorbed by the powder layer 22 consisting mainly of heavy metals to be a state adequate for radiography and, further an absorption effect of scattered X-rays and a sensitizing effect of phosphor due to secondary electrons based on Compton scattering can be obtained. Accordingly, in radiography employing high energy X-rays, in addition to excellent contrast and sensitivity, granularity and sharpness can be improved.

Improvement effects of sensitivity, granularity and sharpness can be obtained with a simple structure in which powder layer 22 is disposed between support 21 and phosphor layer 23. As a result of this, intensifying screens 25 that can cope with the X-rays of high energy such as 1 MV or more and can improve the granularity and sharpness can be produced with ease and less expensively. In addition, there is no handling problem as existing fluorometallic screens cause and they are advantageous from the viewpoint of cost.

According to the intensifying screens 25 of this embodiment, even when radiographs are taken with X-rays of high energy for treatment such as approximately 4 MV, due to existence of the powder layer 22, the excellent contrast can be obtained. In addition, since excellent sensitivity, granularity and sharpness can be obtained, when the intensifying screen is employed for radiography (medical radiography) as preparatory inspection means of X-ray treatment employing X-rays of high energy, reproducibility of an irradiation field set by a treatment program can be clearly confirmed. That is, excellent recognizability of portions to be treated can be obtained.

Intensifying screens 25 of the aforementioned embodiment can be produced by the following way, for instance.

That is, at least one kind of particles selected from simple particles of metals, alloy particles having heavy metals as main constituent and compound particles having heavy metals as main constituent are mixed with an appropriate amount of binder, followed by addition of organic solvent to result in a powder coating liquid of appropriate viscosity. This powder coating liquid is coated on a support 21 by the use of knife coating or roller coating and is dried to result in a powder layer 22 consisting mainly of heavy metals.

As binders being employed for preparation of powder coating liquid, nitrocellulose, cellulose acetate, ethyl cellulose, polyvinyl butyral, flocculate polyester, polyvinyl acetate, vinylidene chloride-vinyl chloride copolymer, vinyl chloride-vinyl acetate copolymer, polyalkyl (metha) acrylate, polycarbonate, polyurethane, cellulose acetate butyrate, polyvinyl alcohol or the like can be employed. As organic solvents, for instance, ethanol, methyl ethyl ether, butyl acetate, ethyl acetate, ethyl ether, xylene or the like can be cited. By the way, to the powder coating liquid, dispersion agent such as phthalic acid, stearic acid or the like and plasticizer such as triphenyl phosphate, diethyl phthalate or the like can be added.

For the support 21, for instance, such resins as cellulose acetate, cellulose propionate, cellulose acetate butyrate, polyesters such as polyethylene terephthalate, polystyrene, polymethyl methacrylate, polyamide, polyimide, vinyl chloride-vinyl acetate copolymer, polycarbonate or the like can be formed in film to use.

On the other hand, phosphor is mixed with an appropriate amount of binder, followed by addition of organic solvent to prepare a phosphor coating liquid of appropriate viscosity. This phosphor coating liquid is coated on a protective layer 24 by the use of knife coating or roller coating and dried to form a phosphor layer 23. Binders or organic solvents being used for preparation of the phosphor coating liquid can be similar ones employed for preparation of the powder coating liquid. For protective film 24, such transparent resinous films as polyethylene terephthalate, polyethylene, polyvinylidene chloride and polyamide can be employed. As demands arise, dispersion agents such as phthalic acid, stearic acid or the like or plasticizer such as triphenyl phosphate, diethyl phthalate or the like can be added to phosphor coating liquid.

By laminating a support 21 thereon the powder layer 22 containing the aforementioned heavy metals such as W or Mo is formed and a protective film thereon a phosphor layer 23 is formed, an intended X-ray intensifying screen (radiation intensifying screen) 25 can be obtained.

By the way, by coating the phosphor coating liquid directly on the powder layer 22 and drying, followed by laminating thereon a filmy protective film 4 or by coating thereon a protective film coating liquid that is adjusted to an appropriate viscosity by dissolving various kinds of resins in solvent, followed by drying, an X-ray intensifying screen 25 can be produced.

The X-ray intensifying screens 25 can be produced with other method than that described above. That is, a protective film 24 is formed in advance on a flat plate and thereon a phosphor layer 23 and a powder layer 22 are formed sequentially. Thereafter, together with the protective film they are peeled off the plate and on the powder layer 22 thereof a support 21 is laminated.

Next, concrete embodiments of the radiation intensifying screens (X-ray intensifying screen 25) of the aforementioned implementing modes and evaluation results thereof will be described.

EMBODIMENT 5

First, 10 parts by weight of $Gd_2O_2S$:Tb phosphor powder of which average particle diameter is 6.0 $\mu$m is combined with 1 part by weight of vinyl chloride-vinyl acetate copolymer as binder and an appropriate amount of ethyl acetate as organic solvent to prepare a phosphor coating liquid. The phosphor coating liquid is coated uniformly on a protective film consisting of polyethylene terephthalate film of a thickness of 9 $\mu$m by the use of knife coating to be a phosphor coating weight of 1.20 kg/m$^2$ after drying, followed by drying to form a phosphor layer.

On the other hand, 1 part by weight of particles of W metal of an average particle diameter of 3.0 $\mu$m is combined with 1 part by weight of vinyl chloride-vinyl acetate copolymer as binder and an appropriate amount of ethyl acetate as organic solvent to prepare a W particle coating liquid. The W particle coating liquid is coated uniformly on a support by the use of knife coating to be a coating weight of W particles of 10 kg/m$^2{}_1$ followed by drying to form a W powder layer (powder layer). The support consists of polyethylene terephthalate film of which thickness is 250 $\mu$m and in which carbon black is kneaded.

Thereafter, the protective film thereon the phosphor layer is formed and the support thereon the W powder layer is formed are laminated so that the phosphor layer face the W powder layer, resulting in an intended X-ray intensifying screen. This X-ray intensifying screen is provided for performance evaluation to be described later.

EMBODIMENTS 6 AND 7

As constituent particles of powder layer, WC (tungsten carbide) particles of an average particle diameter of 3.5 $\mu$m (Embodiment 6) and W—Re alloy particles (Embodiment 7) of an average particle diameter of 4.0 $\mu$m are coated to be coating weights of 15 kg/m$^2$ (Embodiment 6) and 16 kg/m$^2$ (Embodiment 7), respectively. Except for the above, as identical with Embodiment 5, X-ray intensifying screens are produced, respectively. These X-ray intensifying screens are provided for performance evaluation to be described later.

EMBODIMENT 8 TO 10

As constituent particles of powder layer, Mo particles (Embodiment 8) of an average particle diameter of 5 $\mu$m, Nb particles (Embodiment 9) of an average particle diameter of 8 $\mu$m and Ta particles (Embodiment 10) of an average particle diameter of 7 $\mu$m are coated to be coating weights of 19 kg/m$^2$ (Embodiment 8), 18 kg/m$^2$ (Embodiment 9), and 11 kg/m$^2$ (Embodiment 10), respectively. Except for the above, as identical with Embodiment 5, X-ray intensifying screens are produced, respectively. These X-ray intensifying screens are provided for performance evaluation to be described later.

Comparative Example 9

In the place of the powder layer in Embodiment 5, a lead foil of a thickness of 0.5 mm is employed. In the identical manner with embodiment 1 except for the above, X-ray intensifying screens are prepared. These X-ray intensifying screens are supplied for performance evaluation to be described later.

The respective X-ray intensifying screens of the aforementioned Embodiments 5 through 10 and Comparative Example 9 are evaluated of sensitivity and sharpness with ortho-type X-ray film (Fuji Photo-Film Co: Super HR-S) when X-rays of energy of 4 MV are irradiated. The results are shown in Table 3. By the way, each of photographic sensitivity of intensifying screens is shown as relative value with the value of comparative example as 100. The sharpness, by evaluating MTFs at spatial frequency of 2 lines/mm, is shown as relative values with that of intensifying screen of comparative example 9 as 100.

TABLE 3

| | Powder layer | | | Phosphor Layer | | | |
|---|---|---|---|---|---|---|---|
| | Constituent Particle | Average Particle Diameter ($\mu$m) | Coating Weight (kg/m$^2$) | Phosphor | Coating Weight (kg/m$^2$) | Sensitivity (%) | Sharpness (%) |
| Embodiment 5 | W | 3.0 | 10 | $Gd_2O_2S$:Tb | 1.20 | 100 | 110 |
| Embodiment 6 | WC | 3.5 | 15 | $Gd_2O_2S$:Tb | 1.20 | 100 | 108 |
| Embodiment 7 | W-Re | 4.0 | 16 | $Gd_2O_2S$:Tb | 1.20 | 100 | 105 |
| Embodiment 8 | Mo | 5.0 | 19 | $Gd_2O_2S$:Tb | 1.20 | 101 | 115 |
| Embodiment 9 | Nb | 8.0 | 18 | $Gd_2O_2S$:Tb | 1.20 | 98 | 109 |
| Embodiment 10 | Ta | 7.0 | 11 | $Gd_2O_2S$:Tb | 1.20 | 102 | 112 |
| Comparative Example 9 | (Lead Foil/0.5 mm) | | | $Gd_2O_2S$:Tb | 1.20 | 100 | 100 |

As obvious from Table 3, each X-ray intensifying screen due to Embodiments 5 through 10 shows the sensitivity comparative with those of existing fluorometallic screens (Comparative Example 9) that employ lead foil. That is, these intensifying screens due to the above embodiments are obvious to have performance enough to be applied practically. In addition, each sharpness thereof is remarkably improved compared with that of Comparative Example 9.

INDUSTRIAL APPLICABILITY

First and second intensifying screens of the present invention, while preventing the lowering of sensitivity and sharpness from occurring, are improved in granularity due to the phosphor layer of two-layer structure that is easy in produce and less of restricting factors. Radiation receptors and radiation inspection devices that employ such radiation intensifying screens of the present invention are particularly effective when high sensitivity of radiography system is aimed. Even in such systems, excellent recognizability can be obtained.

Third intensifying screens of the present invention, while having the absorption of high energy X-rays comparable with that of existing fluorometallic intensifying screens that employ lead foil, are improved further in sensitivity, sharpness and granularity. Such intensifying screens can be employed effectively in X-ray radiography using high energy X-rays and such radiation intensifying screens that can cope with high energy X-rays can be provided easily and less expensively.

What is claimed is:

1. An intensifying screen, comprising:

a support;

a first phosphor layer disposed on the support and constituted of particles of a first phosphor having an average particle diameter of $D_1$ and a range coefficient k, which expresses particle size distribution, in the range of from 1.3 to 1.8;

a second phosphor layer disposed on the first phosphor layer and constituted of particles of a second phosphor having an average particle diameter of $D_2$ that satisfies $D_2>D_1$ and a range coefficient k of particle size distribution of in the range of from 1.5 to 2.0; and a protective film disposed on the second phosphor layer.

2. The intensifying screen as set forth in claim 1:

wherein average particle diameter $D_1$ of the particles of the first phosphor is in the range of from 1 to 5 $\mu$m and average particle diameter $D_2$ of the particles of the second phosphor is in the range of from 5 to 20 $\mu$m.

3. The intensifying screen as set forth in claim 1:

wherein when a range coefficient of the particles of the first phosphor is $k_1$ and a range coefficient of the particles of the second phosphor is $k_2$, the particles of the first and second phosphors satisfy a relationship of $k_1<k_2$.

4. The intensifying screen as set forth in claim 1:

wherein when a coating weight per unit area of the particles of the first phosphor in the first phosphor layer is $CW_1$ and a coating weight per unit area of the particles of the second phosphor in the second phosphor layer is $CW_2$, the ratio of the $CW_1$ and $CW_2$ ($CW_1$:$CW_2$) is in the range of from 8:2 to 6:4.

5. The intensifying screen as set forth in claim 1:

wherein the first and second phosphors layer comprises rare earth phosphors.

6. A radiation receptor, comprising:

a film for detecting radiation;

a front intensifying screen laminated along a surface of subject side of the film and consisting of the intensifying screen as set forth in claim 1;

a back intensifying screen laminated along a surface of opposite side from the subject side and consisting of the intensifying screen as set forth in claim 1; and a cassette accommodating the front intensifying screen, the film and the back intensifying screen.

7. The radiation receptor as set forth in claim 6:

wherein when a total coating weight per unit area of phosphor particles of the first and second phosphor layers of the front intensifying screen is $TCW_f$ and a total coating weight per unit area of phosphor particles of the first and second phosphor layers of the back intensifying screen is $TCW_b$, the ratio of $TCW_f$ and $TCW_b$ ($TCW_f$:$TCW_b$) is in the range of 3:7 to 4:6.

8. A device for radiation inspection, comprising:

a radiation source; and the radiation receptor that is set forth in claim 6 disposed opposite to the radiation source through a subject.

9. An intensifying screen, comprising:

a support;

a first phosphor layer disposed on the support and constituted of particles of a first phosphor having an average particle diameter of $D_1$;

a second phosphor layer disposed on the first phosphor layer and constituted of particles of a second phosphor having an average particle diameter of $D_2$ satisfying $D_2>D_1$; and a protective film disposed on the second phosphor layer;

wherein when a coating weight per unit area of the particles of the first phosphor in the first phosphor layer is $CW_1$ and a coating weight per unit area of the particles of the second phosphor in the second phosphor layer is $CW_2$, the ratio of the $CW_1$ and $CW_2$ ($CW_1$:$CW_2$) is in the range of from 8:2 to 6:4.

10. The intensifying screen as set forth in claim 9:

wherein average particle diameter $D_1$ of the particles of the first phosphor is in the range of from 1 to 5 $\mu$m and average particle diameter $D_2$ of the particles of the second phosphor is in the range of from 5 to 20 $\mu$m.

11. The intensifying screen as set forth in claim 9:

wherein the first and second phosphors layer comprises rare earth phosphors.

12. A radiation receptor, comprising:

a film for detecting radiation;

the front intensifying screen that is laminated along on a surface of subject side of the film and is set forth in claim 9;

the back intensifying screen that is laminated along on a surface opposite to the subject side of the film and is set forth in claim 9; and a cassette accommodating the front intensifying screen, the film and the back intensifying screen.

13. The radiation receptor as set forth in claim 12:

wherein when a total coating weight per unit area of phosphor particles of the first and second phosphor layers of the front intensifying screen is $TCW_f$ and a total coating weight per unit area of phosphor particles of the first and second phosphor layers of the back intensifying screen is $TCW_b$, the ratio of $TCW_f$ and $TCW_b$ ($TCW_f$:$TCW_b$) is in the range of 3:7 to 4:6.

14. A device for radiation inspection, comprising:

a radiation source;

the radiation receptor that is set forth in claim 12 disposed opposite to the radiation source through a subject.

15. An intensifying screen, comprising:

a support;

a phosphor layer disposed on the support;

a protective layer disposed on the phosphor layer; and a powder layer disposed between the support and the phosphor layer, consisting of at least one kind of particles selected from simple particles of metal, alloy particles consisting mainly of metal and compound particles consisting mainly of metal, and having a thickness of 2 to 40 kg/m$^2$ in terms of weight per unit area.

16. The intensifying screen as set forth in claim 15:

wherein the metal is heavy metal.

17. The intensifying screen as set forth in claim 16:

wherein the heavy metal is at least one kind selected from W, Mo, Nb and Ta.

18. The intensifying screen as set forth in claim 16:

wherein an amount of the metal in the particles constituting the powder layer is 60% or more by weight.

19. The intensifying screen as set forth in claim 16:

wherein the particles are at least one kind selected from W—Re alloy, W—Mo alloy, W—Nb alloy, W—Ta alloy, Mo—Nb alloy, Mo—Ta alloy, Nb—Ta alloy, WC, $WO_3$, $MoO_3$, MoC, Nb—C and Ta—C.

20. The intensifying screen as set forth in claim 16:

wherein the compounds consisting mainly of the metal are consisting of at least one kind selected from carbides of the metal and oxides of the metal.

21. The intensifying screen as set forth in claim 15:

wherein the intensifying screen is one that is used with X-rays of high energy.

* * * * *

UNITED STATES PATENT AND TRADEMARK OFFICE

CERTIFICATE OF CORRECTION

PATENT NO. : 6,339,224 B1
DATED : January 15, 2002
INVENTOR(S) : Takeshi Takahara et al.

It is certified that error appears in the above-identified patent and that said Letters Patent is hereby corrected as shown below:

Column 2,
Line 56, “an” should read -- a --.

Column 9,
Line 27, “of from” should read -- of --.

Column 10,
Line 67, “an” should read -- a --.

Signed and Sealed this

Nineteenth Day of November, 2002

*Attest:*

*Attesting Officer*

JAMES E. ROGAN
*Director of the United States Patent and Trademark Office*